US012612226B2

(12) United States Patent
Rice et al.

(10) Patent No.: US 12,612,226 B2
(45) Date of Patent: Apr. 28, 2026

(54) BEVERAGE SEALING CAP

(71) Applicant: STASIS PRESERVATION LLC, Santa Ana, CA (US)

(72) Inventors: Tyler Bywaters Rice, Santa Ana, CA (US); Ryan C. Wilson, San Diego, CA (US)

(73) Assignee: Stasis Preservation LLC, Santa Ana, CA (US)

( * ) Notice: Subject to any disclaimer, the term of this patent is extended or adjusted under 35 U.S.C. 154(b) by 0 days.

(21) Appl. No.: 18/402,578

(22) Filed: Jan. 2, 2024

(65) Prior Publication Data

US 2025/0333221 A1 Oct. 30, 2025

Related U.S. Application Data

(63) Continuation of application No. 29/819,890, filed on Dec. 17, 2021, now Pat. No. Des. 1,009,627.

(60) Provisional application No. 63/436,457, filed on Dec. 30, 2022.

(51) Int. Cl.
*B65D 51/24* (2006.01)
*B65D 39/00* (2006.01)

(52) U.S. Cl.
CPC ..... *B65D 51/244* (2013.01); *B65D 39/0052* (2013.01)

(58) Field of Classification Search
CPC .. B65D 81/266; B65D 81/267; B65D 81/268; B65D 39/0011; B65D 39/0058; B65D 39/0023; B65D 25/087; B65D 17/506; B65D 17/50; B65D 51/244; B65D 39/0052
See application file for complete search history.

(56) References Cited

U.S. PATENT DOCUMENTS

| | | | | |
|---|---|---|---|---|
| 8,376,161 | B2 * | 2/2013 | Golden | B65D 51/245 53/489 |
| 8,899,428 | B2 * | 12/2014 | Penafiel | B65D 1/023 220/DIG. 19 |
| 10,220,991 | B2 | 3/2019 | Lutz | |
| 10,829,279 | B2 | 11/2020 | Lutz | |
| 11,220,381 | B2 * | 1/2022 | Weinberg | B65D 39/16 |
| 11,565,861 | B2 | 1/2023 | Lutz | |
| 11,628,992 | B2 * | 4/2023 | Exley | B65D 39/00 215/230 |
| 2008/0272084 | A1 | 11/2008 | Laporta | |
| 2011/0278256 | A1 | 11/2011 | Suh | |
| 2011/0290757 | A1 | 12/2011 | Purdy | |
| 2018/0002081 | A1 * | 1/2018 | Lutz | B65D 51/244 |
| 2019/0270560 | A1 * | 9/2019 | Lutz | B65D 39/0029 |

* cited by examiner

*Primary Examiner* — Kareen K Thomas
(74) *Attorney, Agent, or Firm* — EastmaIP; Gary L. Eastman, Esq.

(57) ABSTRACT

A beverage sealing cap that absorbs oxygen keeps a bottled beverage, such as a bottle of wine, fresh after opening and re-sealing. The beverage sealing cap is made with a thermoplastic elastomer stopper containing an oxygen absorber. When inserted into an opened beverage bottle, the stopper seals the bottle to prevent ingress of air, while the oxygen absorber removes the oxygen present in the air inside the bottle. As a result, the contents of the bottle are preserved in a fresh state, avoiding degradation of flavor and waste due to spoilage.

4 Claims, 5 Drawing Sheets

BEVERAGE SEALING CAP

RELATED APPLICATION

This application claims priority to U.S. Design patent application Ser. No. 29/819,890 for a "Bottled Beverage Preservation Cap" filed on Dec. 17, 2021, and currently co-pending, and U.S. Provisional Patent Application Ser. No. 63/436,457 for a "Beverage Sealing Cap" filed on Dec. 30, 2022, and currently co-pending.

FIELD OF THE INVENTION

The present invention pertains generally to beverage preservation. More particularly, the present invention provides an oxygen-depleting tool suitable for use with opened beverage bottles. The present invention is particularly, but not exclusively, useful as a stopper with freshness-preserving properties for wine bottles.

BACKGROUND OF THE INVENTION

Spoiled wine contributes to significant waste, both from an economic and a food perspective. Increased consumption of wine—U.S. wine consumption has increased by about a third since 2005—has resulted in a corresponding increase of waste. The average household throws away the equivalent of two glasses of wine per week, resulting in approximately twenty bottles worth of wine wasted per year.

Spoilage tends to result from oxidation. When a bottle of wine is opened, oxygen enters and reacts with the wine, distorting the flavor over time, even when the bottle has been sealed again. The industry has attempted to respond to the problem, but without much success. Vacuum stoppers have failed to provide satisfactory results, since as much as twenty percent of the air is still left in the bottle: The result is at best a moderate slowing of the rate of spoilage.

In view of the above, it would be advantageous to provide an easy-to-use and effective tool for keeping wine fresh.

SUMMARY OF THE INVENTION

Disclosed is a beverage sealing cap that absorbs oxygen and keeps a bottled beverage, such as a bottle of wine, fresh after opening and re-sealing. A tapered stopper with a low-profile top is made of recyclable thermoplastic elastomer (TPE) that gives the stopper a rubber-like elasticity, allowing the stopper to seal a beverage bottle. The TPE stopper is free of bisphenol A (BPA) and phthalates, thus avoiding the potential health issues raised by these substances.

The stopper has a cavity containing an oxygen absorber. The oxygen absorber contains a substance, such as iron powder, or a mixture of substances, that removes oxygen from the air. The oxygen absorber is kept fresh until use by a cap on the bottom of the stopper. When the stopper is placed on a bottle, the oxygen absorber removes the oxygen from the air in the bottle, thereby preventing spoilage of the bottle's contents.

The top is approximately cylindrical in shape, with a low height with respect to its diameter, and extends beyond the largest width of the stopper. The stopper is tapered, with its maximum diameter at the top, and has a wide step for use with screw-cap bottles. The oxygen absorber is held in place in the cavity of the stopper by a plug positioned also inside the cavity and near the bottom of the stopper. The plug allows for the ingress and egress of air into the cavity so that the oxygen absorber can remove the oxygen from the air; in a preferred embodiment, this is accomplished by one or more apertures extending through the plug.

The stopper and top, as well as the plug and the bottom cap for the stopper are made through industry standard processes, such as injection molding. The oxygen absorber is made by insertion of the oxygen-absorbing substance or substances into an air-permeable container, such as a pouch. The components are then assembled, with the oxygen absorber being placed into the cavity of the stopper, the plug also positioned to hold the oxygen absorber in place, and the bottom cap placed over the bottom of the stopper.

To use the beverage sealing cap, the cap at the bottom of the stopper is removed, the beverage sealing cap is placed over the opening of an open bottle, and the top is pressed down firmly so that the stopper enters the top portion of the bottle's neck and creates a firm seal. When inserted into an opened beverage bottle, the stopper seals the bottle to prevent ingress of air, while the oxygen absorber removes the oxygen present in the air inside the bottle. As a result, the contents of the bottle are preserved in a fresh state, avoiding degradation of flavor and waste due to spoilage. When in use with a bottle of wine, the beverage sealing cap will preserve the flavor of the wine for at least several months, far outlasting the preservation provided by replacing the original cork or cap, or by using a vacuum stopper.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION

Figure 1:
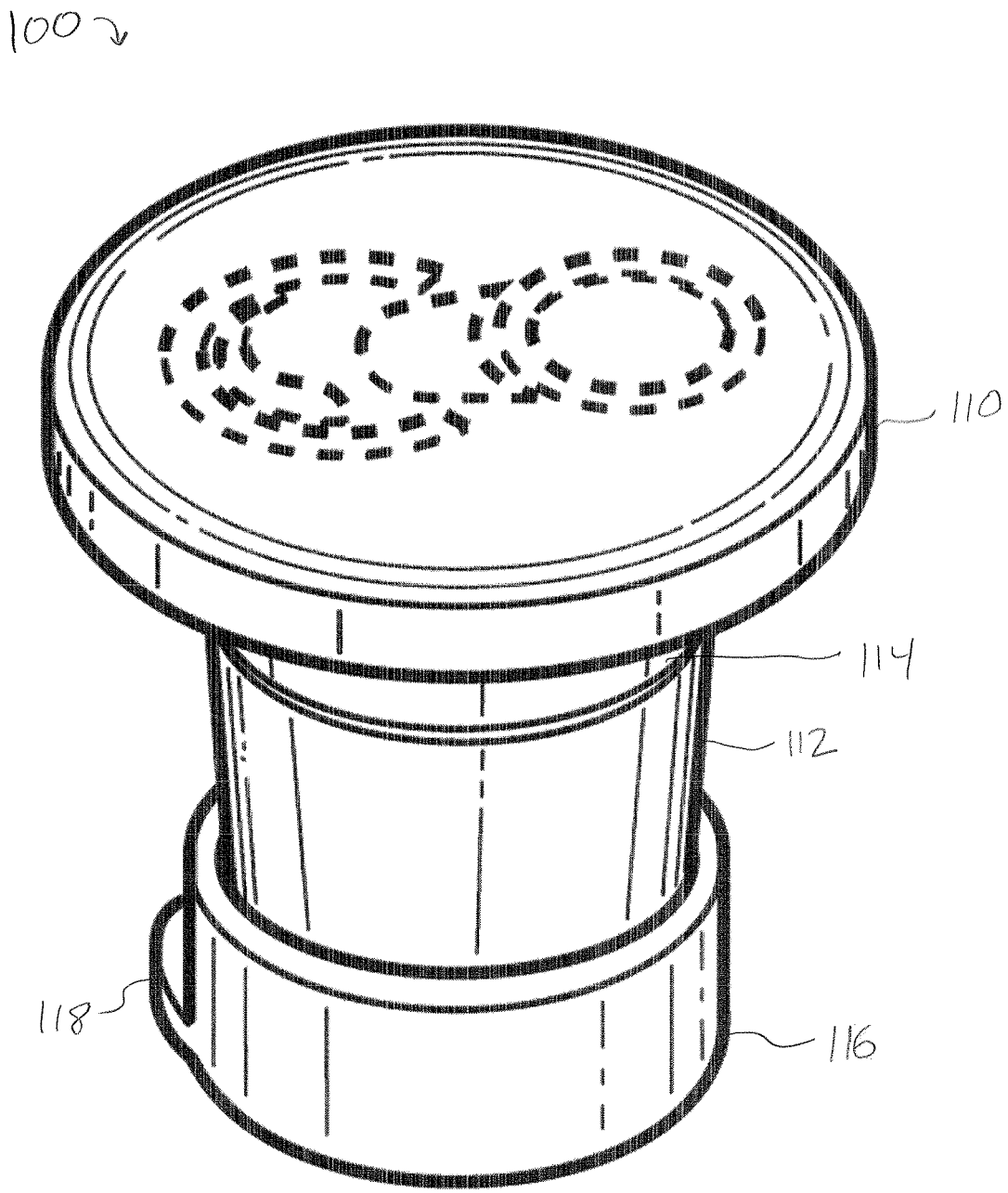
FIG. 1 is a top perspective view of a preferred embodiment of a beverage sealing cap with a lower pop-cap placed on the bottom to maintain freshness.

Referring initially to FIG. 1, a top perspective view of a preferred embodiment of a beverage sealing cap is illustrated and generally designated 100. Beverage sealing cap 100 has a top 110 with a low profile, from which extends a stopper 112.

In a preferred embodiment, stopper 112 is made of recyclable thermoplastic elastomer (TPE) that gives the stopper 112 a rubber-like elasticity, including the ability to be stretched and compressed, and return to its original shape after the stress is removed. Stopper 112 is tapered, being wider at the top and narrowing down to its narrowest point at the bottom. The tapered shape and rubbery nature of stopper 112 allow it to create an airtight seal when pressed into the opening of a bottle. At the top of stopper 112 is a step 114 that allows it to work with screw-cap bottles.

A removable bottom pop-cap 116 seals the bottom of stopper 112 prior to use so that the oxygen absorber 122 (shown in FIG. 4) is not exhausted prior to placement of beverage sealing cap 100 on a bottle. A tab 118 on pop-cap 116 facilitates its removal from stopper 112.

Figure 2:
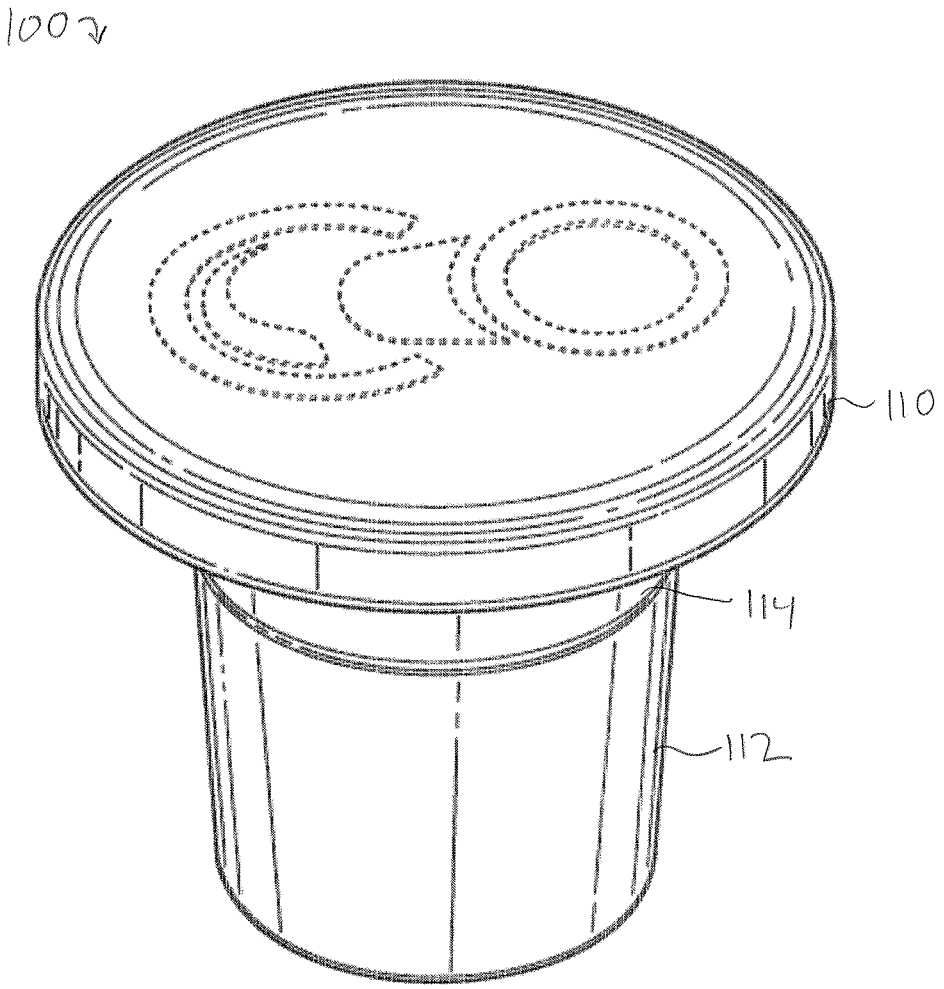
FIG. 2 is a top perspective view of the beverage sealing cap without the lower pop-cap.

Referring now to FIG. 2, beverage sealing cap 100 is shown with pop-cap 116 (shown in FIG. 1) removed. In this configuration, beverage sealing cap 100 is ready for use by placement on an open bottle such that the bottom portion of stopper 112 is pressed into the mouth of the bottle.

Figure 3:
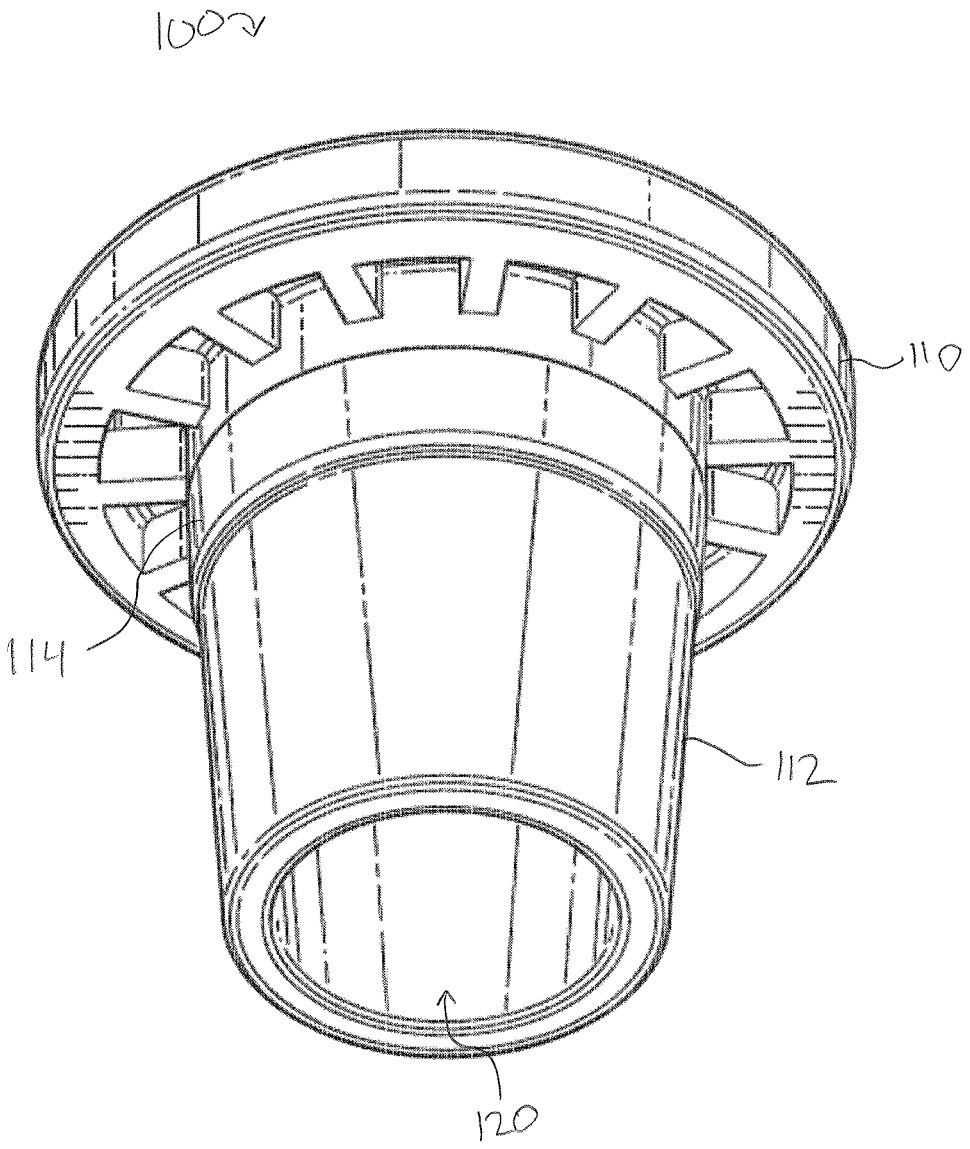
FIG. 3 is a bottom perspective view of the beverage sealing cap without the lower pop-cap.
Figure 4:
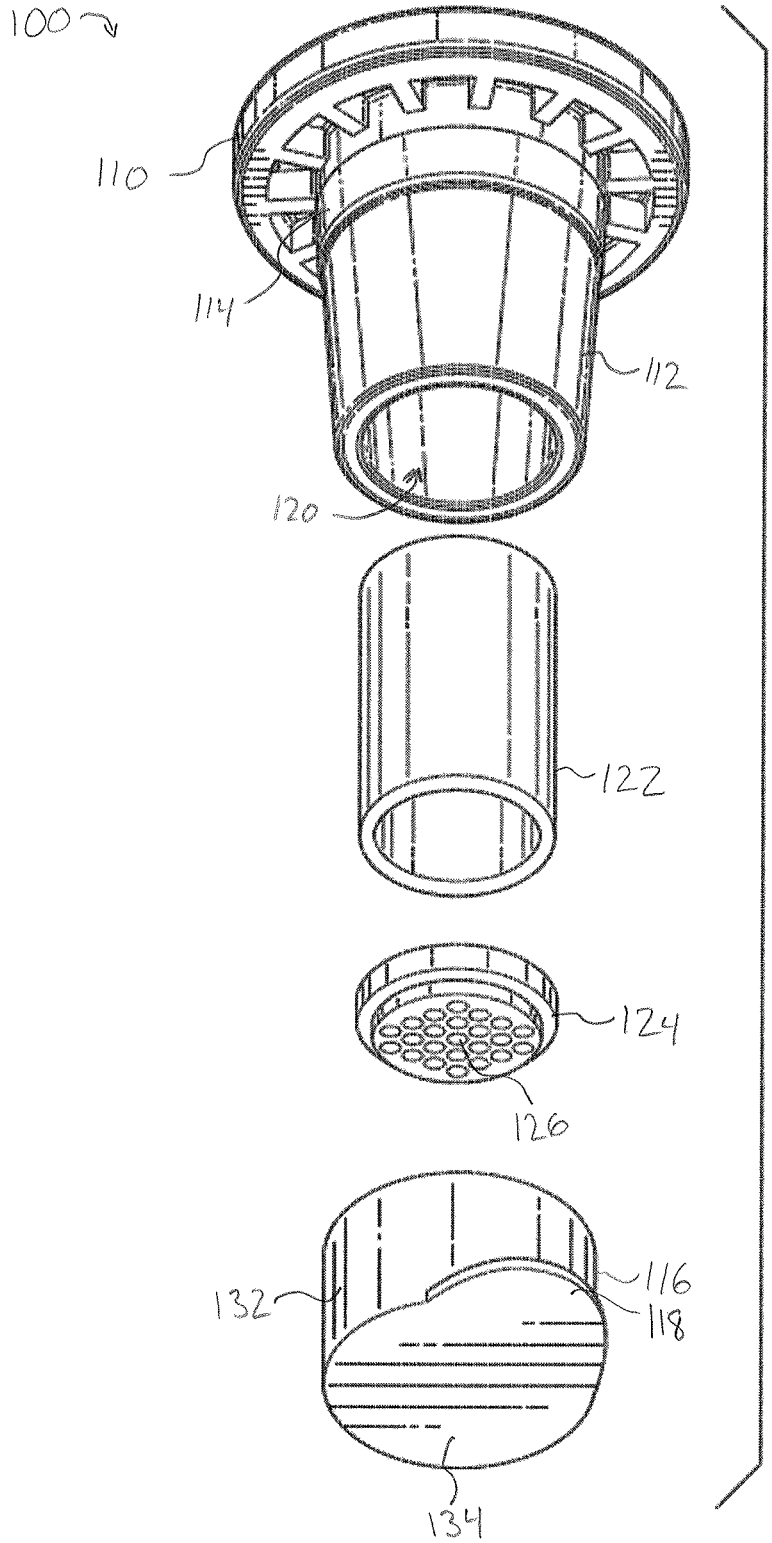
FIG. 4 is an exploded view of the beverage sealing cap.

Referring now to FIG. 3, a bottom perspective view of beverage sealing cap 100 is shown, without bottom pop-cap 116 and, for illustrative purposes, without internal components illustrated in FIG. 4. Stopper 112 is generally hollow, with an aperture 120 filled with internal components and covered by pop-cap 116 until the removal of pop-cap 116.

Referring now to FIG. 4, an exploded view of beverage sealing cap 100 is shown. The internal components, shown here by way of illustration, but ordinarily located inside aperture 120, include an oxygen absorber 122 and a plug 124 to keep the oxygen absorber in place.

Oxygen absorber 122 is an air-penetrable container, such as a pouch, containing an oxygen-absorbing earthen material, such as iron powder. The oxygen-absorbing material reacts with oxygen, resulting in the removal of oxygen from the air. For example, in the case of iron powder, oxygen molecules are removed from the air as the iron powder reacts with it to form ferric hydroxide. When beverage sealing cap 100 is placed on a wine bottle, this reaction results in oxygen being removed from the air inside the bottle. In some embodiments, iron powder is used with salt, activated carbon, or both to provide the oxygen-absorbing material for oxygen absorber 122.

The use of oxygen absorbers in food preservation has been limited to dry foods: The oxygen absorbers need contact with air to work, which can be hindered by a moist environment. Moreover, a low oxygen environment with moist food can contribute to the growth of anaerobic bacteria, presenting potential problems for the eventual consumer of the food.

Thus, the use of oxygen absorbers with beverages is novel and unique. The placement of oxygen absorber 122 in beverage sealing cap 100, which is placed on the top of the bottle, allows oxygen absorber 122 full contact with the air in the bottle, especially when the bottle is in an upright position. The acid content of beverages for which beverage sealing cap 100 is intended for use avoids issues related to anaerobic bacteria. For example, the acid present in grapes makes wine suitable for the anaerobic environment necessary to preserve its flavor.

Plug 124 has one or more apertures 126 that allow air in a bottle to reach oxygen absorber 122, while nonetheless preventing oxygen absorber 122 from unintended egress from aperture 120 of stopper 112. Although an embodiment with several apertures 126 is presented for illustrative purposes, another preferred embodiment has a single aperture 126.

Bottom pop-cap 116 sits over the bottom portion of stopper 112, preventing the ingress of air into aperture 120 and thereby conserving oxygen absorber 122 until beverage sealing cap 100 is to be used. As illustrated, bottom pop-cap 116 is generally cylindrical, having a round sidewall 132 and a bottom surface 134. Extending from the bottom surface 134 is tab 118, which allows for easy removal of bottom pop-cap 116 by a user. The top of bottom pop-cap 116 is open, allowing bottom pop-cap 116 to be placed over the bottom of stopper 112. In a preferred embodiment, bottom pop-cap 116 is made from a firmer plastic than the TPE of stopper 112 and top 110 into which stopper 112 is integrated. Nonetheless, embodiments in which stopper 112 and bottom pop-cap 116 are made from the same material, such as TPE, are fully contemplated herein.

Figure 5:
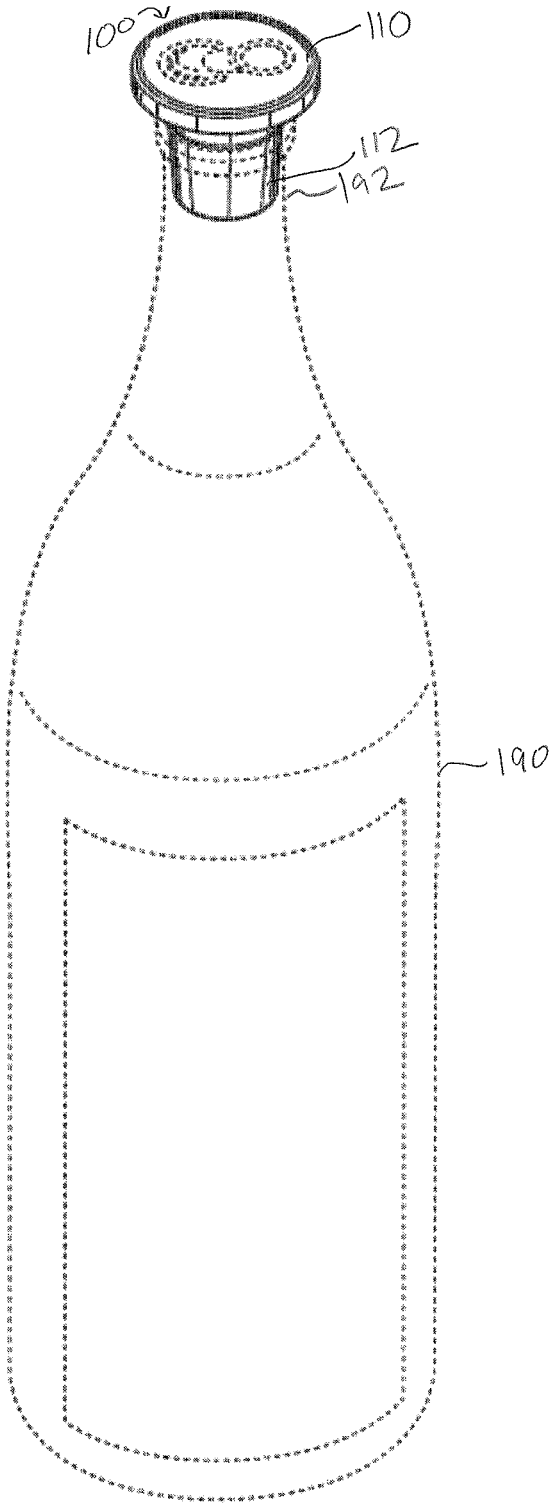
FIG. 5 is a top perspective view of the beverage sealing cap placed on a bottle.

Referring now to FIG. 5, beverage sealing cap 100 is shown in a typical usage scenario. To use beverage sealing cap 100, a user removes bottom pop-cap 116, and places beverage sealing cap 100 over an open wine bottle 190, pressing firmly on the top 110 of beverage sealing cap 100 so that stopper 112 enters the top portion of the neck 192 of bottle 190, sealing the bottle 190. The oxygen absorber 122 (shown in FIG. 4) inside stopper 112 immediately begins removing the oxygen inside bottle 190, thus preserving the contents in a fresh state. The beverage sealing cap 100 is able to preserve the fresh taste of a bottle of wine for several months or longer.

While there have been shown what are presently considered to be preferred embodiments of the present invention, it will be apparent to those skilled in the art that various changes and modifications can be made herein without departing from the scope and spirit of the invention.

What is claimed is:

1. A beverage sealing cap, comprising:

a stopper having an aperture;

an oxygen absorber within the aperture;

a plug configured to hold the oxygen absorber within the aperture; and a pop-cap configured to seal the aperture and prevent ingress of oxygen and exhaustion of the oxygen absorber, the pop-cap removable to allow placement of the stopper onto a bottle, wherein the plug is further configured to allow the ingress and egress of air, such that the oxygen absorber removes oxygen from the air in a bottle on which the stopper is placed.

2. The beverage sealing cap of claim 1, wherein the pop-cap has a tab facilitating removal of the pop-cap from the stopper.

3. A beverage sealing cap, consisting of:

a stopper having an aperture;

an oxygen absorber within the aperture;

a plug configured to hold the oxygen absorber within the aperture; and a pop-cap configured to seal the aperture and prevent ingress of oxygen and exhaustion of the oxygen absorber, the pop-cap removable to allow placement of the stopper onto a bottle, wherein the plug is further configured to allow the ingress and egress of air, such that the oxygen absorber removes oxygen from the air in a bottle on which the stopper is placed.

4. The beverage sealing cap of claim 3, wherein the pop-cap has a tab facilitating removal of the pop-cap from the stopper.

* * * * *